US010006233B2

(12) United States Patent
Laurance

(10) Patent No.: US 10,006,233 B2
(45) Date of Patent: Jun. 26, 2018

(54) SAFETY GATE HINGE

(71) Applicant: THE BOEING COMPANY, Chicago, IL (US)

(72) Inventor: Steven J. Laurance, Everett, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days. days.

(21) Appl. No.: 14/956,312

(22) Filed: Dec. 1, 2015

(65) Prior Publication Data

US 2017/0152691 A1 Jun. 1, 2017

(51) Int. Cl.

| | |
|---|---|
| ***E05D 11/06*** | (2006.01) |
| ***E05D 3/02*** | (2006.01) |
| ***E04H 17/14*** | (2006.01) |
| ***E04G 1/15*** | (2006.01) |
| ***E04G 5/14*** | (2006.01) |
| ***E05D 11/00*** | (2006.01) |
| ***E04G 1/18*** | (2006.01) |
| ***E05D 5/06*** | (2006.01) |

(52) U.S. Cl.

CPC ..... *E05D 11/06* (2013.01); *E04G 1/15* (2013.01); *E04G 1/18* (2013.01); *E04G 5/141* (2013.01); *E04H 17/14* (2013.01); *E05D 3/02* (2013.01); *E05D 5/06* (2013.01); *E05D 11/0054* (2013.01); *E05Y 2201/11* (2013.01); *E05Y 2800/41* (2013.01); *E05Y 2900/40* (2013.01); *E05Y 2900/402* (2013.01)

(58) Field of Classification Search

CPC ..... E05D 11/06; E05D 11/0054; E05D 3/02
See application file for complete search history.

(56) References Cited

U.S. PATENT DOCUMENTS

| | | | | |
|---|---|---|---|---|
| 345,905 | A * | 7/1886 | Kochsmeier | |
| 5,873,847 | A * | 2/1999 | Bennett | A61F 5/013 16/285 |
| 6,702,542 | B1 * | 3/2004 | Chance | B60P 1/02 414/347 |
| 6,718,596 | B2 * | 4/2004 | Kohlstrand | E05D 5/062 16/235 |
| 8,347,460 | B2 * | 1/2013 | Minegishi | E05D 11/1057 16/333 |
| 8,578,560 | B1 * | 11/2013 | Swinehart | A61G 5/10 16/324 |
| 8,661,618 | B2 * | 3/2014 | Jablonski | E05D 11/1007 16/320 |

(Continued)

*Primary Examiner* — Alvin C Chin-Shue
(74) *Attorney, Agent, or Firm* — Patterson + Sheridan, LLP

(57) ABSTRACT

A hinge apparatus that includes a stationary hinge portion, which includes a first bracket configured to be attached to a fixed surface, a first arm extending from the first bracket, and a second arm extending from the first bracket. The first and second brackets include axial holes with a hinge pin arranged therethrough. The hinge pin defines a rotation axis. The stationary hinge portion also includes a stop plate extending away from the first bracket and connected to the first arm. The hinge apparatus also includes a rotatable hinge portion, which includes a body arranged around the hinge pin between the first and second arms and a stop body extending from the body along the rotation axis. Ends of the stop body contact the stop plate to limit rotation of the body about the rotation axis. A second bracket configured to be attached to a movable body.

20 Claims, 6 Drawing Sheets

(56) References Cited

U.S. PATENT DOCUMENTS

| | | | | |
|---|---|---|---|---|
| 2008/0092332 | A1* | 4/2008 | Lowen | E05D 5/00 16/221 |
| 2011/0035906 | A1* | 2/2011 | Esaki | E05D 3/02 16/374 |
| 2012/0006629 | A1* | 1/2012 | Heath | B66B 13/185 187/335 |
| 2015/0027808 | A1* | 1/2015 | Baillargeon | B66F 17/006 182/3 |

* cited by examiner

SAFETY GATE HINGE

BACKGROUND

Aspects described herein relate to a hinge for a gate, and more specifically, to a hinge that includes built-in stops to limit a range of motion of the gate, wherein the built-in stops care coverable to avoid pinch points.

SUMMARY

According to one aspect, a hinge comprises a stationary hinge portion and a rotatable hinge portion. The stationary hinge portion includes a first bracket configured to be attached to a fixed surface. The stationary hinge portion also includes a first arm extending from the first bracket, wherein the first arm includes a first hole therethrough. The stationary hinge portion also includes a second arm extending from the first bracket. The second arm includes a second hole therethrough. The first and second holes are substantially coaxial. The stationary hinge portion also includes a hinge pin arranged in the first and second holes through the first arm and the second arm. The hinge pin defines a rotation axis. The stationary hinge portion also includes a stop plate extending away from the first bracket and connected to the first arm. The rotatable hinge portion includes a first body arranged around the hinge pin between the first and second arms. The rotatable hinge portion also includes a first stop body extending from the body along the rotation axis. Ends of the stop body contact the stop plate to limit rotation of the body about the rotation axis. The rotatable hinge portion also includes a second bracket configured to be attached to a movable body.

According to one aspect, a raised platform comprises an elevated platform and an elevator arranged adjacent to the elevated platform. The elevator is movable between a first position in which a standing surface of the elevator is even with the elevated platform and at least one second position in which the standing surface of the elevator is below the elevated platform. The raised platform also includes a fence arranged on the elevated platform along a perimeter adjacent to the elevator, wherein the fence includes a pivotable gate. The raised platform also includes a hinge connecting the pivotable gate to the fence. The hinge includes a stationary hinge portion and a rotatable hinge portion. The stationary hinge portion includes a first bracket configured to be attached to a fixed surface. The stationary hinge portion also includes a first arm extending from the first bracket, wherein the first arm includes a first hole therethrough. The stationary hinge portion also includes a second arm extending from the first bracket. The second arm includes a second hole therethrough. The first and second holes are substantially coaxial. The stationary hinge portion also includes a hinge pin arranged in the first and second holes through the first arm and the second arm, wherein the hinge pin defines a rotation axis. The stationary hinge portion also includes a first stop plate extending away from the first bracket and connected to the first arm. The rotatable hinge portion includes a body arranged around the hinge pin between the first and second arms. The rotatable hinge portion also includes a first stop body extending from the body along the rotation axis. Ends of the stop body contact the stop plate to limit rotation of the body about the rotation axis. The rotatable hinge portion also includes a second bracket configured to be attached to a movable body.

According to one aspect, a fence comprises a fixed fence portion, a pivotable gate, and a hinge connecting the pivotable gate to the fixed fence portion. The hinge includes a stationary hinge portion and a rotatable hinge portion. The stationary hinge portion includes a first bracket configured to be attached to a fixed surface. The stationary hinge portion also includes a first arm extending from the first bracket, wherein the first arm includes a first hole therethrough. The stationary hinge portion also includes a second arm extending from the first bracket. The second arm includes a second hole therethrough. The first and second holes are substantially coaxial. The stationary hinge portion also includes a hinge pin arranged in the first and second holes through the first arm and the second arm, wherein the hinge pin defines a rotation axis. The stationary hinge portion also includes a first stop plate extending away from the first bracket and connected to the first arm. The rotatable hinge portion includes a body arranged around the hinge pin between the first and second arms. The rotatable hinge portion also includes a first stop body extending from the body along the rotation axis, wherein ends of the stop body contact the stop plate to limit rotation of the body about the rotation axis. The rotatable hinge portion also includes a second bracket configured to be attached to a movable body.

BRIEF DESCRIPTION OF ILLUSTRATIONS

FIG. 5A is a top view of a rotatable hinge portion of the hinge shown in FIG. 3 a.

DETAILED DESCRIPTION

In the following, reference is made to aspects presented in this disclosure. However, the scope of the present disclosure is not limited to specific described aspects. Instead, any combination of the following features and elements, whether related to different aspects or not, is contemplated to implement and practice contemplated aspects. Furthermore, although aspects disclosed herein may achieve advantages over other possible solutions or over the prior art, whether or not a particular advantage is achieved by a given aspect is not limiting of the scope of the present disclosure. Thus, the following aspects, features, and advantages are merely illustrative and are not considered elements or limitations of the appended claims except where explicitly recited in a claim(s). Likewise, reference to "the invention" or "the disclosure" shall not be construed as a generalization of any inventive subject matter disclosed herein and shall not be considered to be an element or limitation of the appended claims except where explicitly recited in a claim(s).

In various environments, such as manufacturing environments, fences and gates are used to prevent workers from inadvertently entering certain areas. For example, fences and gates may be arranged along a perimeter of an elevated platform to prevent a worker from falling over an edge. The fence may include a gate to allow passage through the fence. A stop plate may be raised from a floor surface or extend from a wall surface next to the gate that stops the gate in a closed position. Such stop plates could be a tripping hazard or an injury hazard to workers passing through the open gate. Such stop plates could also be a pinching hazard where the stop plate meets the moving gate. In some environments, the gates may have to be lifted (e.g., by approximately one inch) to be moved from the closed position. Such lifting of the gates could cause injury to workers trying to open the gate.

Figure 1:
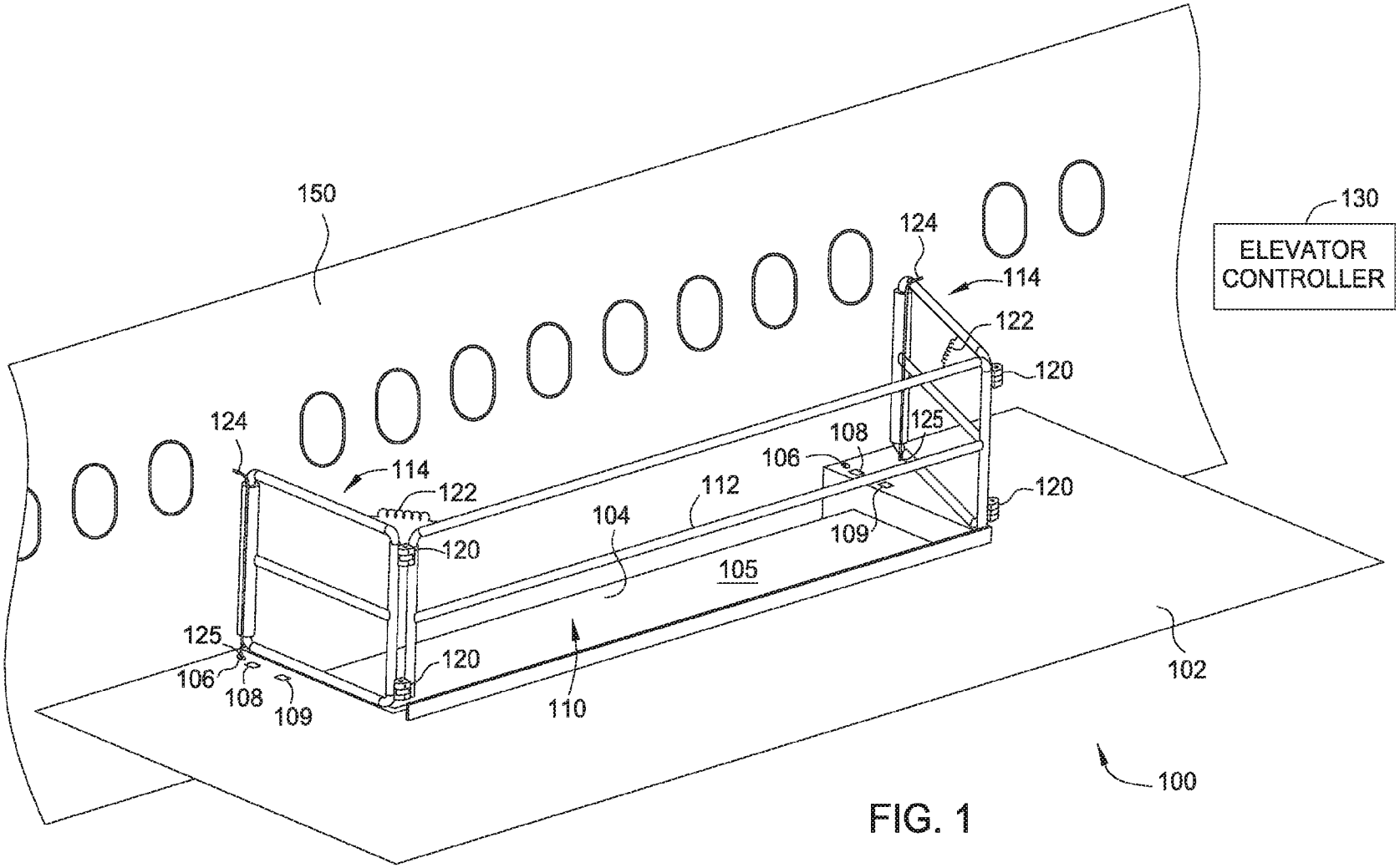
FIG. 1 is a perspective view of an elevated work platform with an elevator, or in the elevator is lowered below a level of the elevated work platform, and wherein the elevator is surrounded by a fence and gates.

FIG. 1 is a perspective view of raised platform 100 that includes an elevated platform 102 and an elevator 104. In the exemplary scenario depicted in FIG. 1, the raised platform 100 is illustrated next to an aircraft fuselage section 150, which may be ten, twenty, or more feet above the floor of a manufacturing environment, maintenance environment, hanger, or the like. The elevator 104 is depicted in a position in which a standing surface 105 of the elevator 104 is below the elevated platform 102. The elevator 104 can move between a position in which the standing surface 105 of the elevator 104 is level with the elevated platform 102 and lowered positions, such as the lowered position illustrated in FIG. 1. The lowered positions of the elevator 104 could enable workers standing on the standing surface 105 of the elevator 104 to access portions of the aircraft fuselage 150 that are below the level of the elevated platform 102.

A barrier 110 is arranged along a perimeter of the elevated platform 102 adjacent to the elevator 104. The barrier 110 reduces the likelihood that a worker on the elevated platform 102 could inadvertently fall off the elevated platform 102 onto the elevator 104 when the elevator 104 is in a lowered position. The barrier 110 includes a fence 112 and two pivotable gates 114. As will be described in greater detail below, the pivotable gates 114 can include mechanical and/or electrical features that prevent the gates from opening or discourage opening of the gates when the elevator 104 is in a lowered position. For purposes of illustration, one of the pivotable gates 114 is illustrated in an opened position even though the elevator 104 is in a lowered position. The pivotable gates 114 are connected to the fence 112 by hinges 120. The barrier 110 depicted in FIG. 1 includes two hinges 120 per pivotable gate 114. In various other aspects, more or fewer hinges 120 could be included with each pivotable gate 114. In certain aspects, the pivotable gates 114 could be biased in a closed position by a biasing member 122. Examples of such a biasing member 122 include a resilient spring, an elastomeric material, and a cable or rope with a weight that urges the gate 114 toward a closed position.

In various aspects, the elevated platform 102 and/or the barrier 110 include one or more features to keep the pivotable gates 114 in a closed position. For example, the elevated platform 102 could include holes 106 proximate to the pivotable gates 114 and arranged through the elevated platform 102 or in the elevated platform 102. In such aspects, the pivotable gates 114 could include plungers 124 attached thereto. The plungers 124 include ends 125 that can engage the holes 106 to hold the pivotable gates 114 in a closed position. To open the gate 114, a worker would lift the plunger 124 such that the end 125 disengages from the hole 106, thereby enabling the worker to open the gate 114. As another example, the elevated platform 102 could include solenoids or actuators 108 arranged in apertures in the elevated platform 102. The solenoids or actuators 108 could energize when the pivotable gates 114 are closed such that a latch connected to the solenoid or actuator 108 interferes with the gates 114, thereby preventing the pivotable gates 114 from opening. Alternatively, the solenoids or actuators 108 could be arranged on the gates 114, and the latch connected to the solenoid or actuator 108 could engage the holes 106 in the elevated platform 102. The elevated platform 102 could include proximity sensors 109 arranged along the perimeter of the elevated platform 102 adjacent to the elevator 104. The proximity sensors 109 could detect whether the pivotable gates 114 are in the closed position or whether the pivotable gates 114 are open. The solenoids and actuators 108 and the proximity sensors 109 could be in communication with an elevator controller 130 or another controller. In the event the elevator 104 is in a lowered position, the elevator controller 130 could transmit a control signal that keeps the solenoids or actuators 108 engaged such that the pivotable gates 114 cannot be opened. Similarly, the elevator controller 130 could prevent the elevator 140 from moving to a lowered position (from the elevated position in which the elevator 104 is level with the elevated platform 102) in the event the proximity sensors 109 detect that one or more of the pivotable gates 114 is not in a closed position.

The hinges 120 include internal features that limit a range of motion (i.e., an amount of rotation) of the respective gates 114. For example, the hinges 120 may stop the pivotable gates 114 at the closed position in a first direction of rotation about the hinges 120 and may stop the pivotable gates 114 after 90° of travel from the closed position. As described in greater detail below, such internal features of the hinges 120 are shielded to prevent possible pinching.

Figure 2:
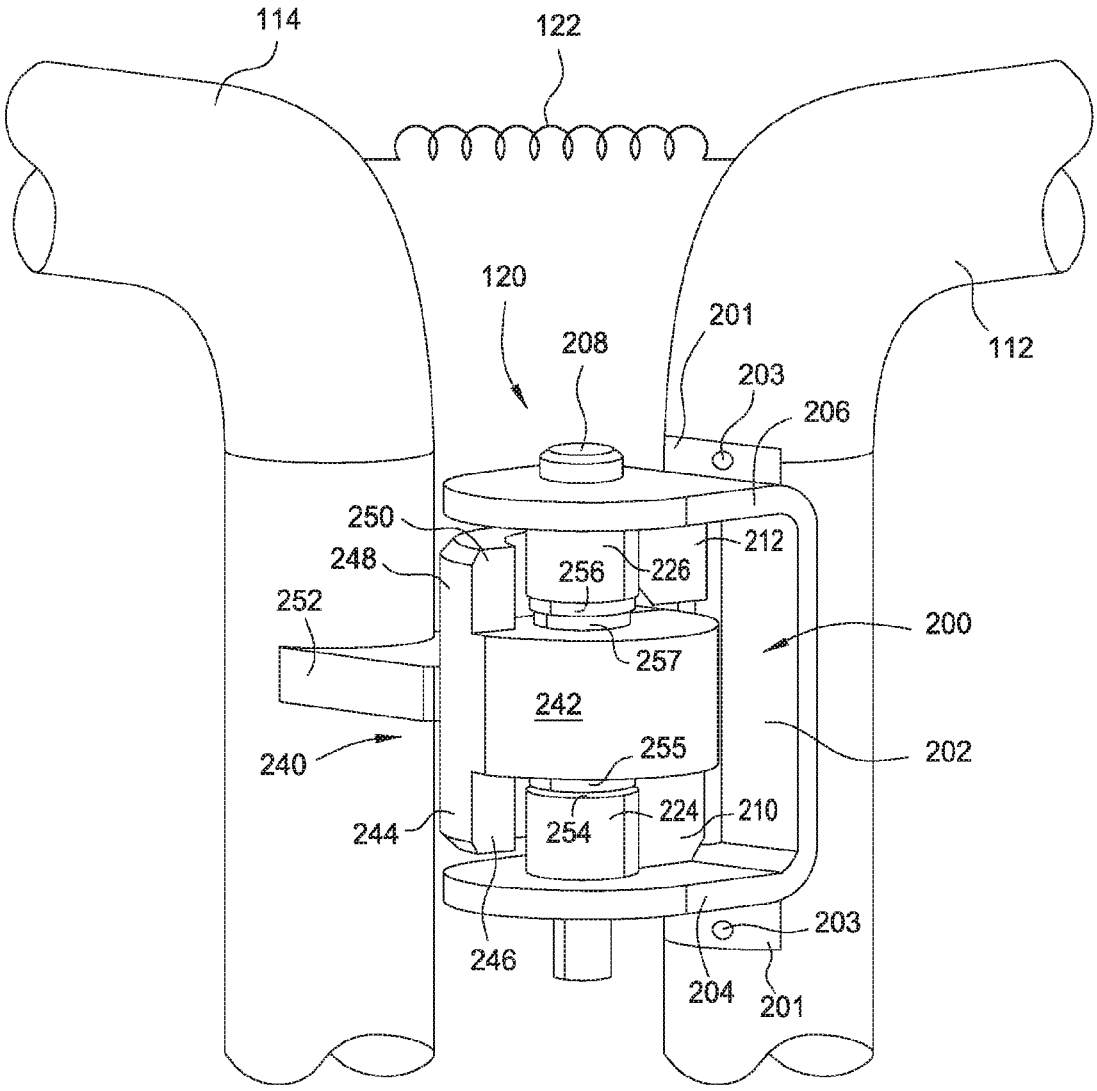
FIG. 2 is a perspective view of a hinge according to at least one aspect for pivotably connecting the gates shown in FIG. 1 to the fence shown in FIG. 1, wherein shields of the hinge have been removed for clarity.
Figure 3B:
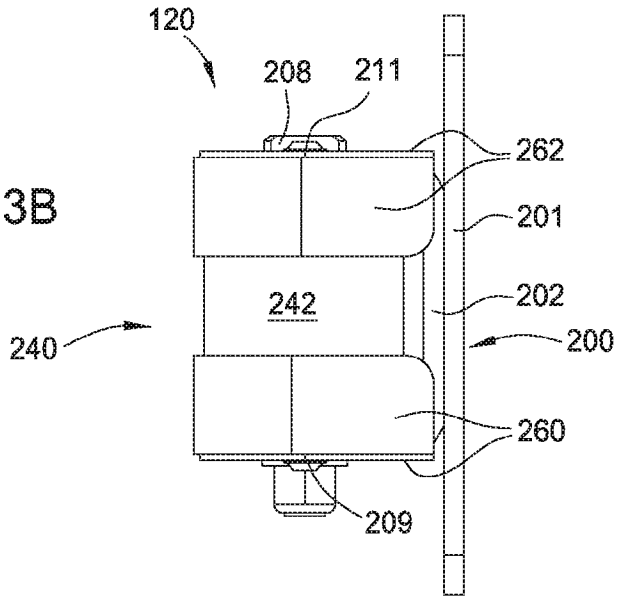
FIG. 3B is a side view of the hinge shown in FIG. 3A.
Figure 3C:
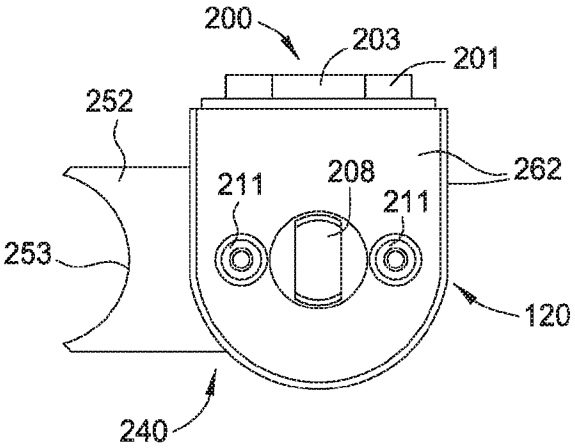
FIG. 3C is a top view of the hinge in FIG. 3A.
Figure 3A:
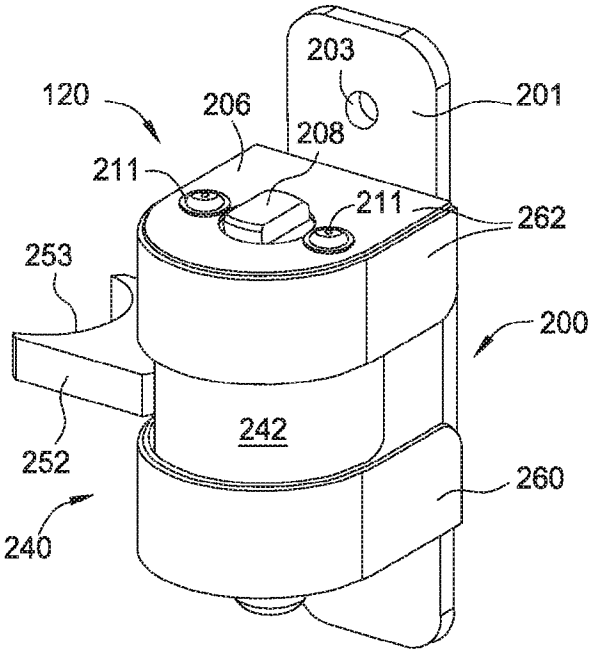
FIG. 3A is a perspective view of the hinge of FIG. 2, wherein shields cover internal portions of the hinge.
Figure 3E:
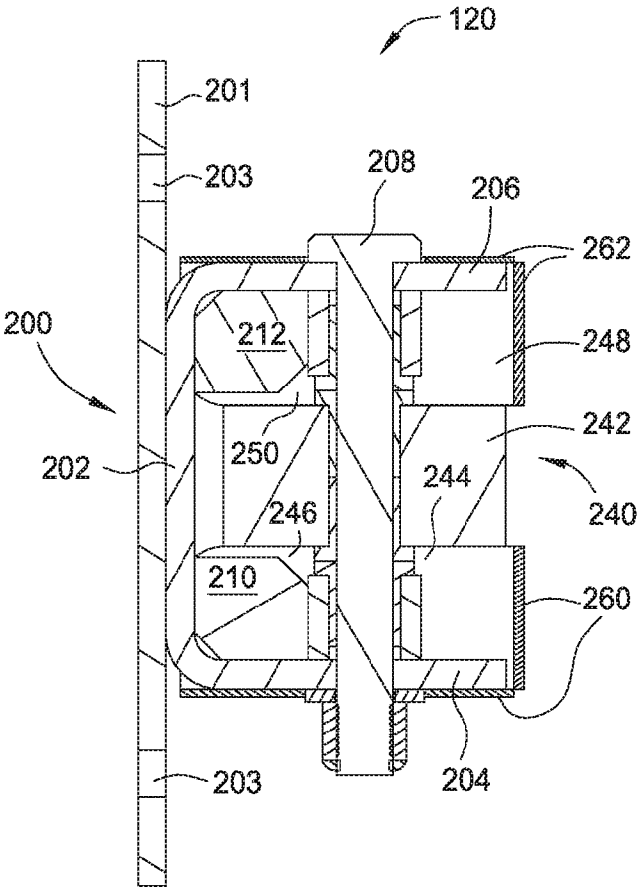
FIG. 3E is a side cross-sectional view (as indicated in FIG. 3D) of the hinge of FIG. 3A.
Figure 3D:
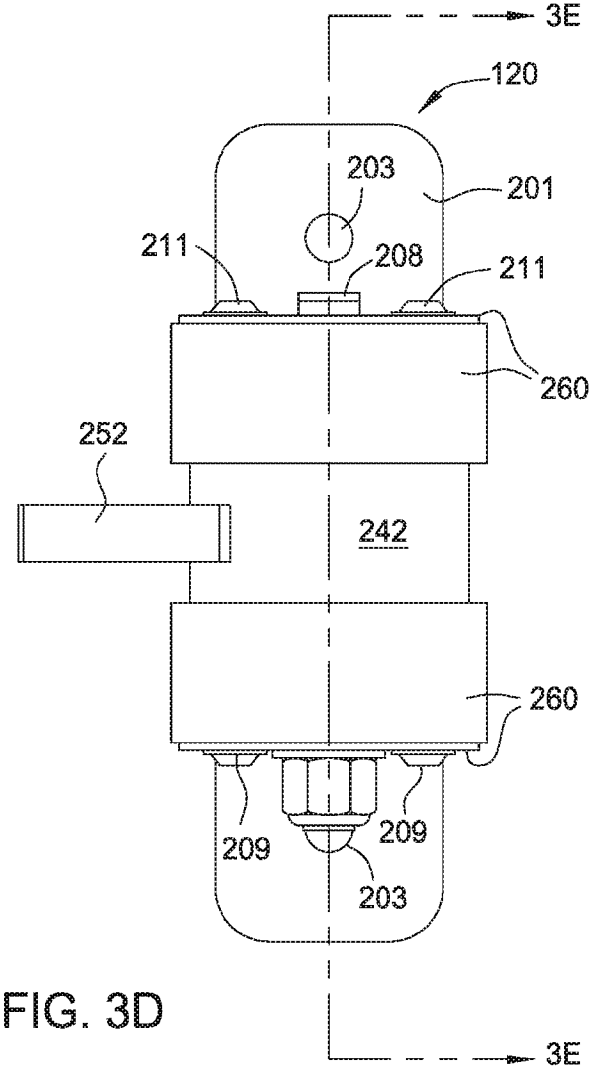
FIG. 3D is a front view of hinge of FIG. 3A.
Figure 4C:
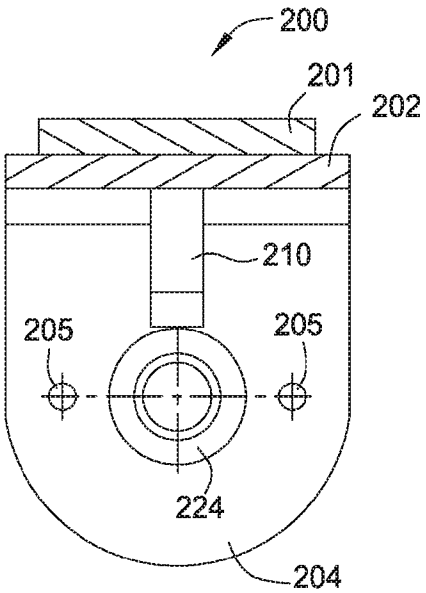
FIG. 4C is a top cross-sectional view (as indicated in FIG. 4B) of the stationary hinge portion shown in FIG. 4A.
Figure 4B:
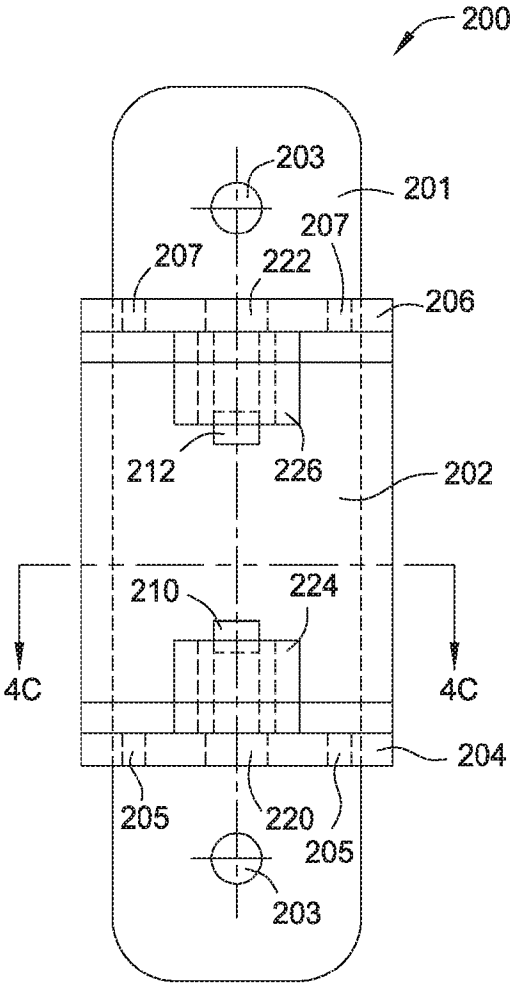
FIG. 4B is a front view of the stationary hinge portion shown in FIG. 4A.
Figure 4A:
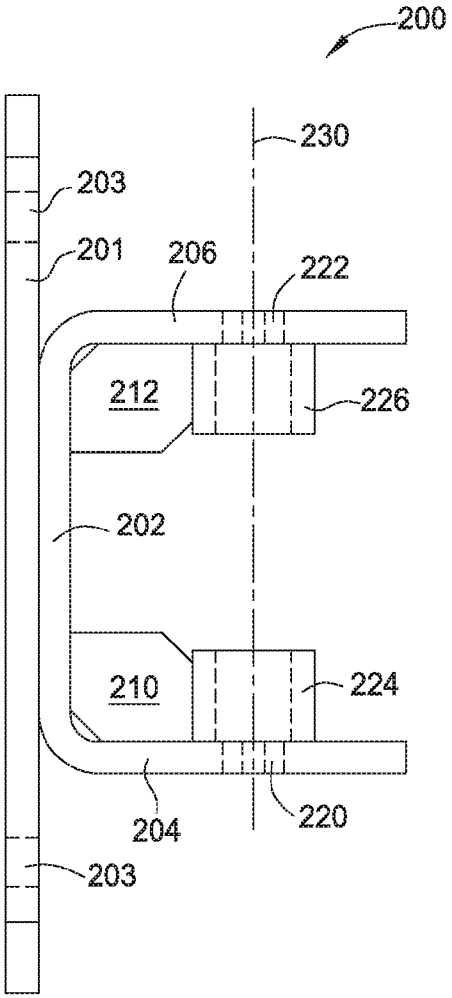
FIG. 4A is a side view of a stationary hinge portion of the hinge shown in FIG. 3A.

FIG. 2 illustrates a perspective view of a hinge 120 arranged between the fence 112 and a gate 114. The hinge 120 includes a stationary hinge portion 200, which is attached to a surface of the fence 112. Since the fence 112 does not move, it is also referred to herein as a fixed surface. The hinge 120 also includes a rotatable hinge portion 240, which is attached to the gate 114. The gate 114 is also referred to herein as a movable body. To illustrate internal features of the hinge 120, shields of the hinge 120 (discussed below) are not shown. FIGS. 3A-3E illustrate the hinge 120 with shields 260 and 262 attached. FIGS. 3A-3D illustrate various views of the hinge 120, and FIG. 3E illustrates a cross-sectional side view of the hinge 120. FIGS. 4A-4C illustrate various views of the stationary hinge portion 200 and FIGS. 5A-5B illustrate various views of the rotatable hinge portion 240.

The stationary hinge portion 200 includes a mounting plate 201 that is attached to or attachable to the fence 112. The mounting plate 201 includes fastener holes 203 that can receive bolts, screws, rivets, or other fasteners to attach the mounting plate 201 to the fence 112. The stationary hinge portion 200 includes a bracket 202 attached to the mounting plate 201. The bracket 202 could be welded to the mounting plate 201, riveted to the mounting plate 201, or otherwise fastened to the mounting plate 201. A first arm 204 and a second arm 206 extend away from the bracket 202. Referring primarily to FIGS. 4A-4C, the first arm 204 includes a first hole 220 therethrough and the second arm 206 includes a second hole 222 therethrough. The first hole 220 and the second hole 222 are substantially coaxial about a rotational axis 230. A hinge pin 208 can pass through the first hole 220 and the second hole 222. In various aspects, the first arm 204 includes a first positioning boss 224 and the second arm 206 includes the second positioning boss 224. The first positioning boss 224 and the second positioning boss 224 extend from the respective first and second arms 204 and 206 toward each other. As discussed in greater detail below, the first positioning bearing 224 and the second positioning bearing 226 can position the rotatable hinge portion 240 relative to the stationary hinge portion 200.

The stationary hinge portion 200 also includes a first stop plate 210 and a second stop plate 212 extending away from the bracket 202. As shown in FIG. 4A, the first stop plate 210 extends from the bracket 202 and connects to the first arm 204. The second stop plate 212 extends from the bracket 202 and connects to the second arm 206. In various aspects, the stationary hinge portion 200 may only include the first stop plate 210 or the second stop plate 212.

Figure 5A:
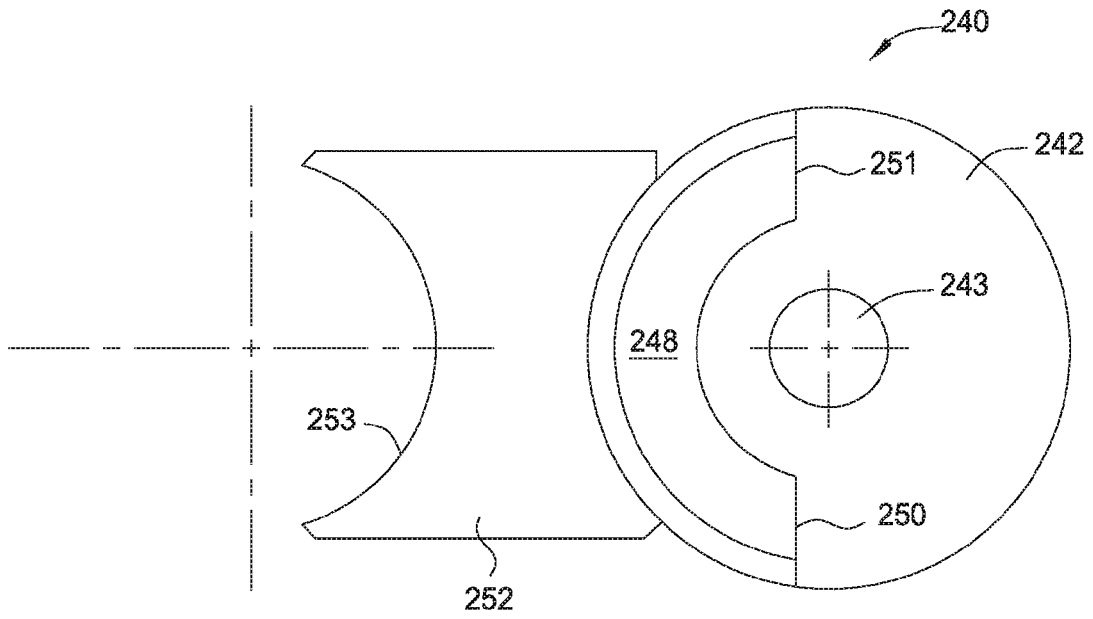
Figure 5B:
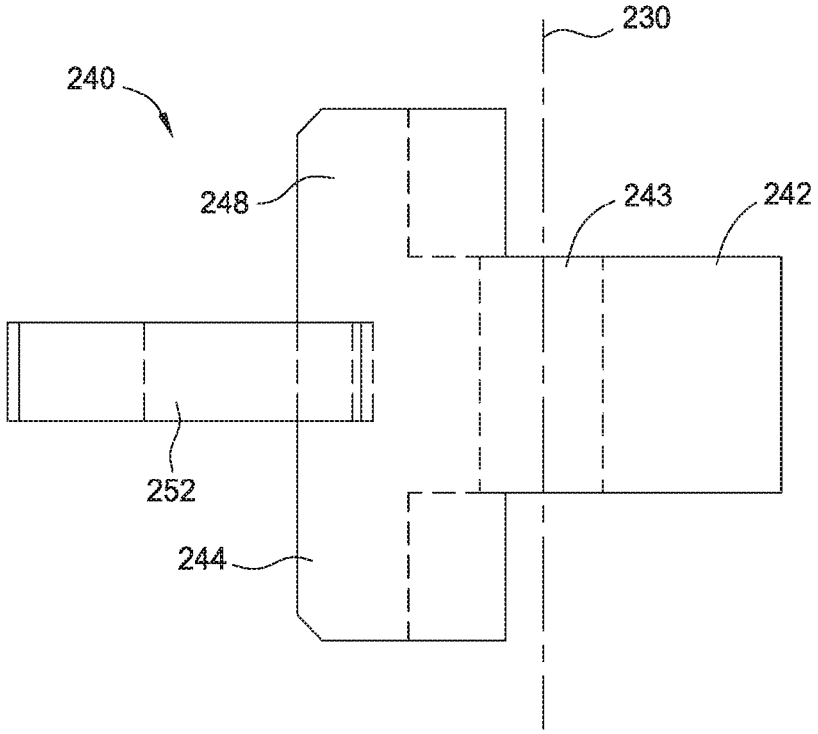
FIG. 5B is a side view of the rotatable hinge portion shown in FIG. 5A.

Referring primarily to FIGS. 5A-5B, the rotatable hinge portion 240 includes a body 242. The body 242 includes a hole 243 therethrough. When assembled, the hole 243 in the body 242 is aligned with the holes 220 and 222 in the first arm 204 and the second arm 206, respectively. The pin 208 passes through the aligned holes 220, 243, and 222 such that the rotatable hinge portion 240 can rotate about the pin 208 relative to the stationary hinge portion 200. The body 242 includes a first stop body 244 extending from the body 242 along the rotational axis 230 and a second stop body 248 extending from the body 242 along the rotational axis 230 in an opposite direction of the first stop body 244. The stop bodies 244 and 248 includes ends. For example, FIG. 5A is a top-down view of the rotatable hinge portion 240 and illustrates the second stop body 248 with ends 250 and 251. In FIG. 2, the end 250 of the second stop body 248 and an end 246 of the first stop body 244 are visible. As shown in greater detail in FIG. 3E, the stop bodies 244 and 248 are aligned with the stop plates 210 and 212, respectively, when the stationary hinge portion 200 and the rotatable hinge portion 240 are assembled. The ends of the stop bodies 244 and 248 can abut the stop plates 210 and 212, respectively, to limit rotation of the rotatable hinge portion 240 about the rotation axis 230 relative to the stationary hinge portion 200. For example, as depicted in FIG. 3E, the end 246 of the first stop body 244 is abutting the first stop plate 210 and the end 250 of the second stop body 248 is abutting the second stop body 212. The abutting ends of the stop bodies and the stop plates prevent the rotatable hinge portion 240 from rotating any further in a particular direction. When the rotatable hinge portion 240 rotates in an opposite direction, such rotation would be constrained by the end 251 of the second stop body 248 and a similar and of the first stop body 244 abutting the stop plates 212 and 210, respectively.

In the exemplary rotatable hinge portion 240 depicted in FIGS. 5A-5B, the stop bodies 244 and 248 cover approximately 180° of the body 242 about the hole 243. The stop bodies 244 and 248 cover slightly less than 180° of the body 242 about the hole 243 to accommodate a thickness of the stop plate 212. As a result of the stop bodies 244 and 248 covering 180° of the body 242 about the hole 243, the rotatable hinge portion 240 would have approximately 180° of rotational travel about the rotational axis 230 relative to the stationary hinge portion 200 before opposite ends of the stop bodies 244 and 248 abutting the stop plates 210 and 212, respectively. By adjusting a dimension of the stop bodies 244 and 248 about the hole 243, the amount of rotational travel of the rotatable hinge portion 240 about the rotational axis 230 relative to the stationary hinge portion 200 can be determined. For example, the stop bodies 244 and 248 could cover approximately 270° of the body 242 about the hole 243. As a result, the rotatable hinge portion 240 would have approximately 90° of rotational travel about the rotational axis 230 relative to the stationary hinge portion 200. As another example, the stop bodies 244 and 248 could cover approximately 90° of the body 242 about the hole 243. As a result, the rotatable hinge portion 240 would have approximately 270° of rotational travel about the rotational axis 230 relative to the stationary hinge portion 200.

As discussed above, in various aspects, the rotatable hinge portion 240 may include only the first stop body 244 or only the second stop body 248. In aspects that include both the first stop body 244 and the second stop body 248, the stop bodies preferably should be positioned identically such that ends of the first stop body 244 abut the first stop plate 210 and ends of the second stop body 248 abut the second stop plate 212 at the same time. As a result, forces between the stop bodies 244 and 248 and the stop plates 210 and 212, respectively, are evenly distributed.

Referring again to FIGS. 5A-5B, the rotatable hinge portion includes a second bracket 252 for connection to the gate 114. In the exemplary elevated platform 102 shown in FIG. 1, the pivotable gates 114 (in the fence 112) could be made from tubular steel, for example. For such an exemplary gate 114 made of tubular steel, the bracket 252 includes a circular arc profile 253 that could engage an outer periphery of the tube of the gate 114. The bracket 252 could be welded to the tube where the circular arc profile 253 engages the tube, for example.

Referring primarily to FIGS. 3A-3E, in various aspects, the hinge 120 could include a first shield 260 and/or a second shield 262 that covers the first stop body 244, the second stop body 244, the first stop plate 210, and the second stop plate 212. As discussed above, the stop bodies and stop plates can abut each other to limit rotation of the rotatable hinge portion 240 relative to the stationary hinge portion 200. Without the shields 260 and 262, such stop bodies and stop plates could pose pinching hazards to workers or objects. The shields 260 and 262 could be formed from one or more pieces of sheet metal. The various aspects, the shields 260 and 262 could be held in place with fasteners that attach to the arms 204 and 206 of the stationary hinge portion 200. For example, referring primarily to FIG. 3D, the first shield 260 could be attached to the first arm 204 with rivets 209. Similarly, the second shield 262 could be attached to the second arm 206 with rivets 211. The shields 260 and 262 are spaced apart such that the bracket 252 of the rotatable hinge portion 240 can extend outwardly from between the shields 260 and 262.

In various aspects, the hinge 120 can include one or more bushings arranged around the pin 208 between the stationary hinge portion 200 and the rotatable hinge portion 240. For example, FIG. 2 illustrates a first bushing 254 arranged between the first positioning boss 224 and the body 242 and a second bushing 256 arranged between the second positioning boss 224 and the body 242. In various aspects, the hinge 120 could include two or more bushings between the body 242 and the positioning bosses 224 and 226. The bushings 254 and 256 can reduce friction forces between the body 242 and the positioning bosses 224 and 226. The bushings 254 and 256 could also be made of a softer material to reduce wear on other components of the hinge 120. For example, the body 242 and the positioning boss 224 and 226 could be made of a steel material and the bushings 254 and 256 could be made of a brass or copper material. In such aspects, the bushings 254 and 256 could wear while the steel body 242 and positioning boss 224 and 226 remain relatively unworn.

In various aspects, the hinge 120 could include one or more biasing mechanisms, such as spring elements or elastomeric elements therein to bias the rotatable hinge portion 240 relative to the stationary hinge portion 200 in a particular rotational position (e.g. in a closed position) about the rotational axis 230. FIG. 2 illustrates a first biasing mechanism 255 arranged between the first positioning boss 224 and the body 242 and a second biasing mechanism 257 arranged between the second positioning boss 224 and the body 242. Rotation of the rotatable hinge portion 240 away from the biased position stretched (or compresses) the biasing mechanism, resulting in a force that urges the rotatable hinge portion 240 toward the biased position.

The descriptions of the various aspects have been presented for purposes of illustration, but are not intended to be exhaustive or limited to the aspects disclosed. Many modifications and variations will be apparent to those of ordinary skill in the art without departing from the scope and spirit of the described aspects. The terminology used herein was chosen to best explain the principles of the aspects, the practical application or technical improvement over technologies found in the marketplace, or to enable others of ordinary skill in the art to understand the aspects disclosed herein.

While the foregoing is directed to certain aspects, other and further aspects may be devised without departing from the basic scope thereof, and the scope thereof is determined by the claims that follow.

What is claimed is:

1. A hinge, comprising:

a stationary hinge portion, including:

a first bracket configured to be attached to a fixed surface;

a first arm extending from the first bracket, wherein the first arm includes a first hole therethrough;

a second arm extending from the first bracket, wherein the second arm includes a second hole therethrough, and wherein the first and second holes are substantially coaxial;

a hinge pin arranged in the first and second holes through the first arm and the second arm, wherein the hinge pin defines a rotation axis;

a stop plate in contact with and extending away from the first bracket and connected to the first arm;

a first positioning boss extending from the first arm and in contact with the stop plate, the first positioning boss having a first opening formed therethrough, the first opening aligned with the first hole; and a second positioning boss extending from the second arm, the second positioning boss having a second opening formed therethrough, the second opening aligned with the second hole; and a rotatable hinge portion, including:

a first body arranged around the hinge pin between the first and second arms;

a first stop body extending from the body along the rotation axis, wherein ends of the stop body contact the stop plate to limit rotation of the body about the rotation axis; and a second bracket configured to be attached to a movable body.

2. The hinge of claim 1, wherein the stationary hinge portion further includes a shield arranged around a periphery of the first arm and extending from the first arm to the body of the rotatable hinge portion such that the stop plate and the first stop body are covered by the shield.

3. The hinge of claim 1, wherein the stationary hinge portion further includes a second stop plate in contact with and extending away from the first bracket and connected to the second arm, and wherein the rotatable hinge portion further includes a second stop body extending from the body along the rotation axis in an opposite direction from the first stop body, wherein ends of the second stop body contact the second stop plate to limit rotation of the body about the rotation axis.

4. The hinge of claim 3, wherein the stationary hinge portion further includes:

a first shield arranged around a periphery of the first arm and extending from the first arm to the body of the rotatable hinge portion such that the stop plate and the stop body are covered by the first shield; and a second shield arranged around a periphery of the second arm and extending from the second arm to the body of the rotatable hinge portion such that the second stop plate and the second stop body are covered by the second shield.

5. The hinge of claim 1, further comprising a biasing member configured to bias the first body toward contact with the stop plate in a first direction about the rotation axis.

6. The hinge of claim 1, further comprising a first at least one bushing arranged around the hinge pin between the first arm and the first body and a second at least one bushing arranged around the hinge pin between the second arm and the body.

7. A raised platform, comprising:

an elevated platform;

an elevator arranged adjacent to the elevated platform, wherein the elevator is movable between a first position in which a standing surface of the elevator is even with the elevated platform and at least one second position in which the standing surface of the elevator is below the elevated platform;

a fence arranged on the elevated platform along a perimeter adjacent to the elevator, wherein the fence includes a fixed fence portion and a pivotable gate; and a hinge connecting the pivotable gate to the fixed fence portion, the hinge including:

a stationary hinge portion, including:

a first bracket configured to be attached to the fixed fence portion;

a first arm extending from the first bracket, wherein the first arm includes a first hole therethrough;

a second arm extending from the first bracket, wherein the second arm includes a second hole therethrough, and wherein the first and second holes are substantially coaxial;

a hinge pin arranged in the first and second holes through the first arm and the second arm, wherein the hinge pin defines a rotation axis;

a first stop plate in contact with and extending away from the first bracket and connected to the first arm;

a first positioning boss extending from the first arm and in contact with the first stop plate, the first positioning boss having a first opening formed therethrough, the first opening aligned with the first hole; and a second positioning boss extending from the second arm, the second positioning boss having a second opening formed therethrough, the second opening aligned with the second hole; and a rotatable hinge portion, including:

a body arranged around the hinge pin between the first and second arms;

a first stop body extending from the body along the rotation axis, wherein ends of the stop body contact the stop plate to limit rotation of the body about the rotation axis; and a second bracket configured to be attached to the pivotable gate.

8. The raised platform of claim 7, wherein the stationary hinge portion further includes a shield arranged around a periphery of the first arm and extending from the first arm to the body of the rotatable hinge portion such that the first stop plate and the first stop body are covered by the shield.

9. The raised platform of claim 7, wherein the stationary hinge portion further includes a second stop plate in contact with and extending away from the first bracket and connected to the second arm, and wherein the rotatable hinge portion further includes a second stop body extending from the body along the rotation axis in an opposite direction from the first stop body, wherein ends of the second stop body contact the second stop plate to limit rotation of the body about the rotation axis.

10. The raised platform of claim 9, wherein the stationary hinge portion further includes:

a first shield arranged around a periphery of the first arm and extending from the first arm to the body of the rotatable hinge portion such that the stop plate and the stop body are covered by the first shield; and a second shield arranged around a periphery of the second arm and extending from the second arm to the body of the rotatable hinge portion such that the second stop plate and the second stop body are covered by the second shield.

11. The raised platform of claim 7, further comprising a biasing member configured to bias the body toward contact with the stop plate in a first direction about the rotation axis.

12. The raised platform of claim 7, further comprising a first at least one bushing arranged around the hinge pin between the first arm and the body and a second at least one bushing arranged around the hinge pin between the second arm and the body.

13. The raised platform of claim 7, wherein the elevated platform includes a hole proximate to the gate; and further comprising a plunger connected to the pivotable gate, wherein the plunger is movable between a first position to a second position, wherein an end of the plunger engages the hole in the first position to retain the gate in a closed position, and wherein the end of the plunger clears the hole in the second position to allow the pivotable gate to pivot about the hinge.

14. The raised platform of claim 13, further comprising a biasing member that biases the plunger toward the first position.

15. The raised platform of claim 7, further comprising:

a controller operable to move the elevator between the first position and the at least one second position; and a sensor that detects when the pivotable gate is in a closed position, wherein the sensor is in communication with the controller, wherein the controller prevents movement of the elevator from the first position unless the sensor detects that the pivotable gate is in the closed position.

16. The raised platform of claim 15, further comprising an actuator controlled by the controller, wherein the actuator is movable between a first position and a second position, wherein the actuator prevents the pivotable gate from moving from the closed position in the second position, and wherein the controller provides a control signal to move the actuator to the second position when the elevator is not in the first position.

17. A fence, comprising:

a fixed fence portion;

a pivotable gate; and a hinge connecting the pivotable gate to the fixed fence portion, the hinge including:

a stationary hinge portion, including:

a first bracket configured to be attached to the fixed fence portion;

a first arm extending from the first bracket, wherein the first arm includes a first hole therethrough;

a second arm extending from the first bracket, wherein the second arm includes a second hole therethrough, and wherein the first and second holes are substantially coaxial;

a hinge pin arranged in the first and second holes through the first arm and the second arm, wherein the hinge pin defines a rotation axis;

a first stop plate in contact with and extending away from the first bracket and connected to the first arm;

a first positioning boss extending from the first arm and in contact with the first stop plate, the first positioning boss having a first opening formed therethrough, the first opening aligned with the first hole; and a second positioning boss extending from the second arm, the second positioning boss having a second opening formed therethrough, the second opening aligned with the second hole; and a rotatable hinge portion, including:

a body arranged around the hinge pin between the first and second arms;

a first stop body extending from the body along the rotation axis, wherein ends of the stop body contact the stop plate to limit rotation of the body about the rotation axis; and a second bracket configured to be attached to the pivotable gate.

18. The fence of claim 17, wherein the stationary hinge portion further includes a shield arranged around a periphery of the first arm and extending from the first arm to the body of the rotatable hinge portion such that the first stop plate and the first stop body are covered by the shield.

19. The fence of claim 17, wherein the stationary hinge portion further includes a second stop plate in contact with and extending away from the first bracket and connected to the second arm, and wherein the rotatable hinge portion further includes a second stop body extending from the body along the rotation axis in an opposite direction from the first stop body, wherein ends of the second stop body contact the second stop plate to limit rotation of the body about the rotation axis.

20. The fence of claim 19, wherein the stationary hinge portion further includes:

a first shield arranged around a periphery of the first arm and extending from the first arm to the body of the rotatable hinge portion such that the stop plate and the stop body are covered by the first shield; and a second shield arranged around a periphery of the second arm and extending from the second arm to the body of the rotatable hinge portion such that the second stop plate and the second stop body are covered by the second shield.

* * * * *